US007128291B1

(12) United States Patent
Schanke et al.

(10) Patent No.: US 7,128,291 B1
(45) Date of Patent: Oct. 31, 2006

(54) SPOOL HAVING AN EXTRACTOR BAR

(75) Inventors: Robert L. Schanke, New Berlin, WI (US); Robert F. Behlmer, Wauwatosa, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/885,182

(22) Filed: Jul. 6, 2004

(51) Int. Cl.
*B65H 19/30* (2006.01)

(52) U.S. Cl. ..... 242/533.7; 242/574; 242/597

(58) Field of Classification Search ..... 242/597.3, 242/559.3, 559.4, 533.7, 533, 574, 597, 571, 242/571.3, 571.4, 571.5
See application file for complete search history.

(56) References Cited

U.S. PATENT DOCUMENTS

| | | | | |
|---|---|---|---|---|
| 688,143 | A | 12/1901 | Windle | |
| 1,494,396 | A | 5/1924 | Wendt | |
| 1,530,991 | A | 3/1925 | Forbes | |
| 1,885,192 | A | 11/1932 | Elssner et al. | |
| 1,979,423 | A | 11/1934 | Tondreau | |
| 2,196,489 | A | 4/1940 | Bennett | |
| 2,558,689 | A | 6/1951 | Miller | |
| 2,576,254 | A | 11/1951 | Fletcher | |
| 2,790,246 | A | 4/1957 | May | |
| 4,043,440 | A | 8/1977 | Busch | |
| 4,645,136 | A | 2/1987 | Woodley et al. | |
| 4,798,350 | A | 1/1989 | Jorgesen et al. | |
| 4,893,765 | A | 1/1990 | Randolph | |
| 5,121,584 | A * | 6/1992 | Suter | 53/116 |
| 5,196,082 | A | 3/1993 | Randolph | |
| 5,267,704 | A | 12/1993 | Kitamura et al. | |
| 5,531,398 | A * | 7/1996 | Krska | 242/533.7 |
| 5,758,841 | A | 6/1998 | Ayffre et al. | |
| 6,020,906 | A * | 2/2000 | Adams et al. | 347/217 |
| 6,021,972 | A | 2/2000 | Inoue et al. | |
| 6,302,604 | B1 * | 10/2001 | Bryant et al. | 400/619 |
| 6,307,583 | B1 | 10/2001 | Randolph et al. | |
| 2003/0034419 | A1 * | 2/2003 | Joutsjoki | 242/533.7 |

FOREIGN PATENT DOCUMENTS

| | | |
|---|---|---|
| GB | 673946 | 6/1952 |
| GB | 1137150 | 12/1968 |
| GB | 2211824 A | 7/1989 |
| GB | 2 377 909 A | 1/2003 |
| WO | WO 02/055420 A1 | 7/2002 |

* cited by examiner

*Primary Examiner*—John Q. Nguyen
*Assistant Examiner*—William E. Dondero
(74) *Attorney, Agent, or Firm*—Quarles & Brady LLP

(57) ABSTRACT

A spool suitable for winding material thereon includes an axially extending body having a proximal end and a distal end joined by an outer surface. An extractor bar is mounted for slidable movement relative to the body for urging material wound onto the body toward the body distal end.

26 Claims, 10 Drawing Sheets

SPOOL HAVING AN EXTRACTOR BAR

CROSS REFERENCES TO RELATED APPLICATIONS

Not Applicable.

STATEMENT REGARDING FEDERALLY SPONSORED RESEARCH

Not Applicable.

TECHNICAL FIELD

This invention relates to spools for winding material thereon, and in particular to a spool including an extractor bar for removing material wound thereon.

DESCRIPTION OF THE BACKGROUND ART

Spools are used in various machines for supplying and rewinding material. For example, in a printer, such as a thermal printer, a printing media supply spool includes a roll of printing material that is unwound to feed the printing media past a print head. The print head transfers ink from an ink ribbon onto the printing media. Printing media, such as labels, can include a releasable liner that is peeled away from the printed labels upon ejection of the label from the printer. The liner can then be wound onto a liner rewind spool and collected for removal and disposal. Likewise, the ink ribbon that supplies ink for transferring onto the printing media is supplied by an ink ribbon supply spool that carries a roll of ink ribbon. The ink ribbon unwinds from the ink ribbon supply spool as it is fed past the print head. The used ink ribbon is wound onto a rewind spool for collection and subsequent disposal.

Many spools require a core mounted on a rotatable spool body for collecting the liner or ribbon. The core simplifies removal of the material wound thereon by allowing the material to be removed as a unit. Unfortunately, the core is a disposable part that must be provided when printing, and thus increases the cost of printing. In addition, loading the core on the spool body and securing a leading edge of the liner or ribbon to the core, such as by taping, increases the number of steps, and thus the complexity, necessary to set up a printer. Improper set up of the printer can delay the printing process or even ruin the initial run of printed material.

Coreless spools that eliminate the need for a core have been introduced that wind material directly onto the spool body to eliminate these problems. However, removal of material wound directly onto the spool body is difficult. For example, if the material is wound too tight onto the spool body, a user may have to unwind the material from the coreless spool which is time consuming. Even if the material can be slipped axially off of the spool body, it is very difficult to move the entire roll of wound material as a unit without peeling layers of the roll and creating a mess. Moreover, the leading edge of the material being wound onto the spool must be secured relative to the spool whether it is to a core or the spool body. Therefore, a need exists for a spool that provides a simple method for removing material wound onto a spool without winding the material on a removable core.

SUMMARY OF THE INVENTION

The present invention provides a spool suitable for winding material thereon. The spool includes an axially extending body having a proximal end and a distal end joined by an outer surface. An extractor bar is mounted for slidable movement relative to the body for urging material wound onto the body toward the body distal end.

A general objective of the present invention is to provide a coreless spool that provides a mechanism for easily removing material wound thereon. This objective is accomplished by providing an extractor blade that urges material wound onto the body toward the body distal end for removing the material from the body.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
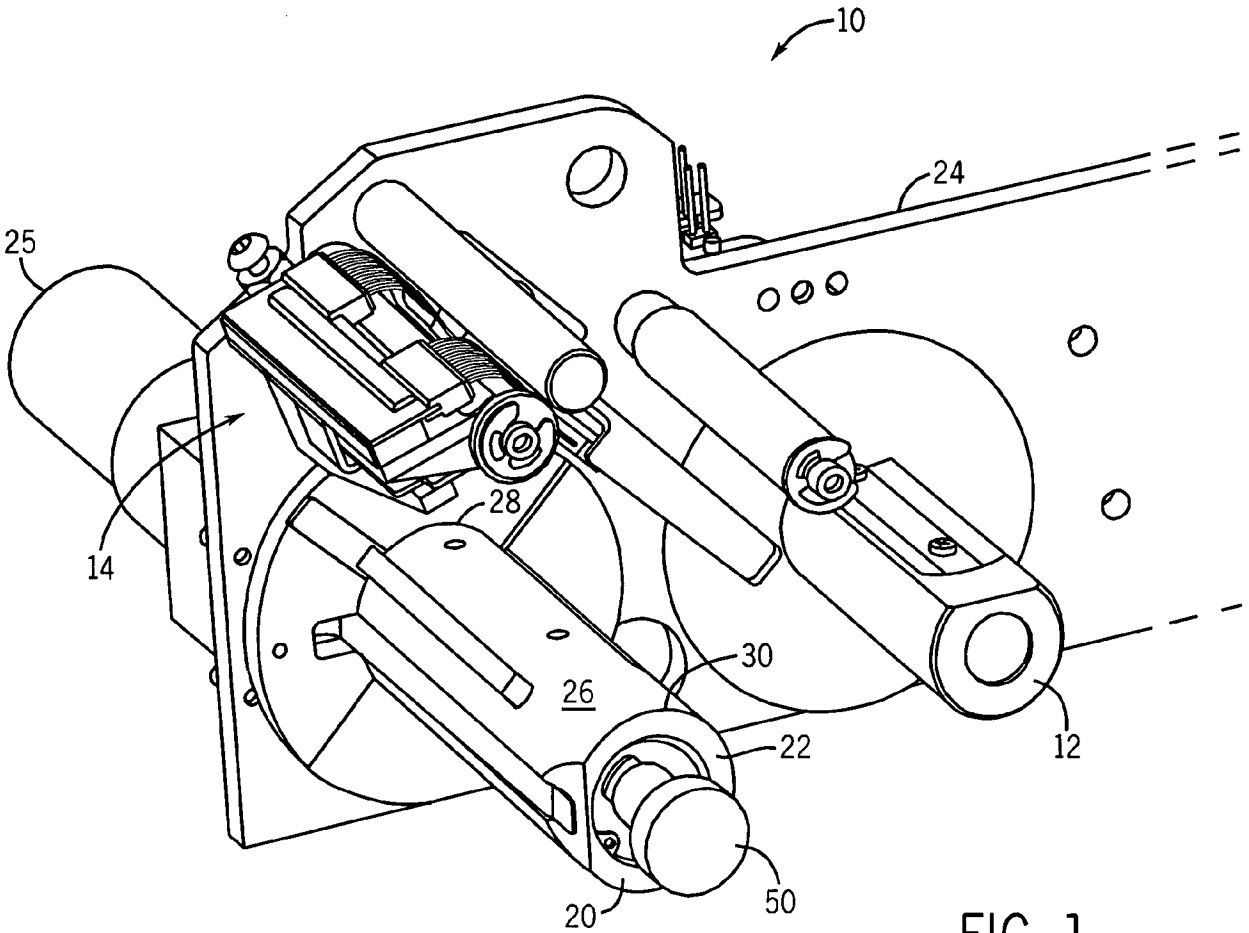
FIG. 1 is a perspective view of a portion of a printing system including a ribbon rewind spool incorporating the present invention.
Figure 2:
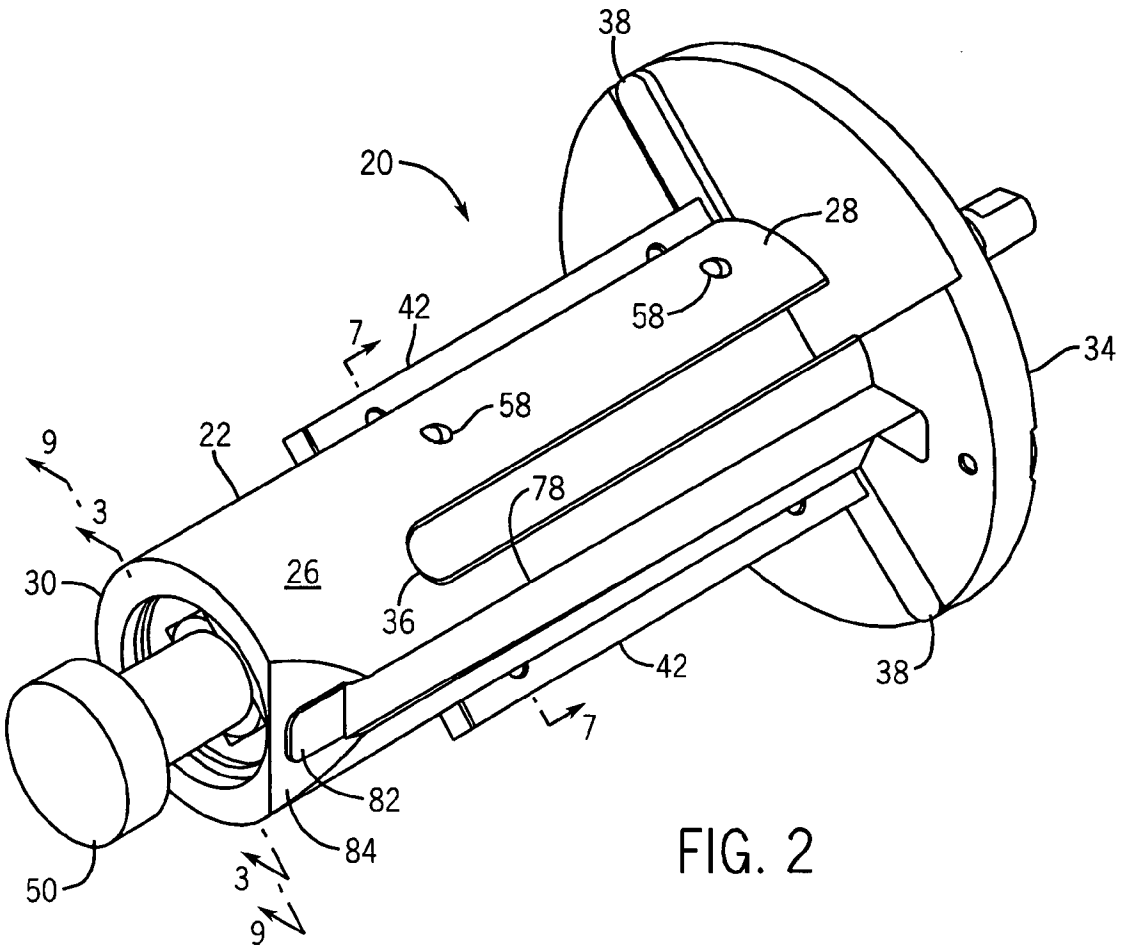
FIG. 2 is a perspective view of the ribbon rewind spool of FIG. 1.
Figure 3:
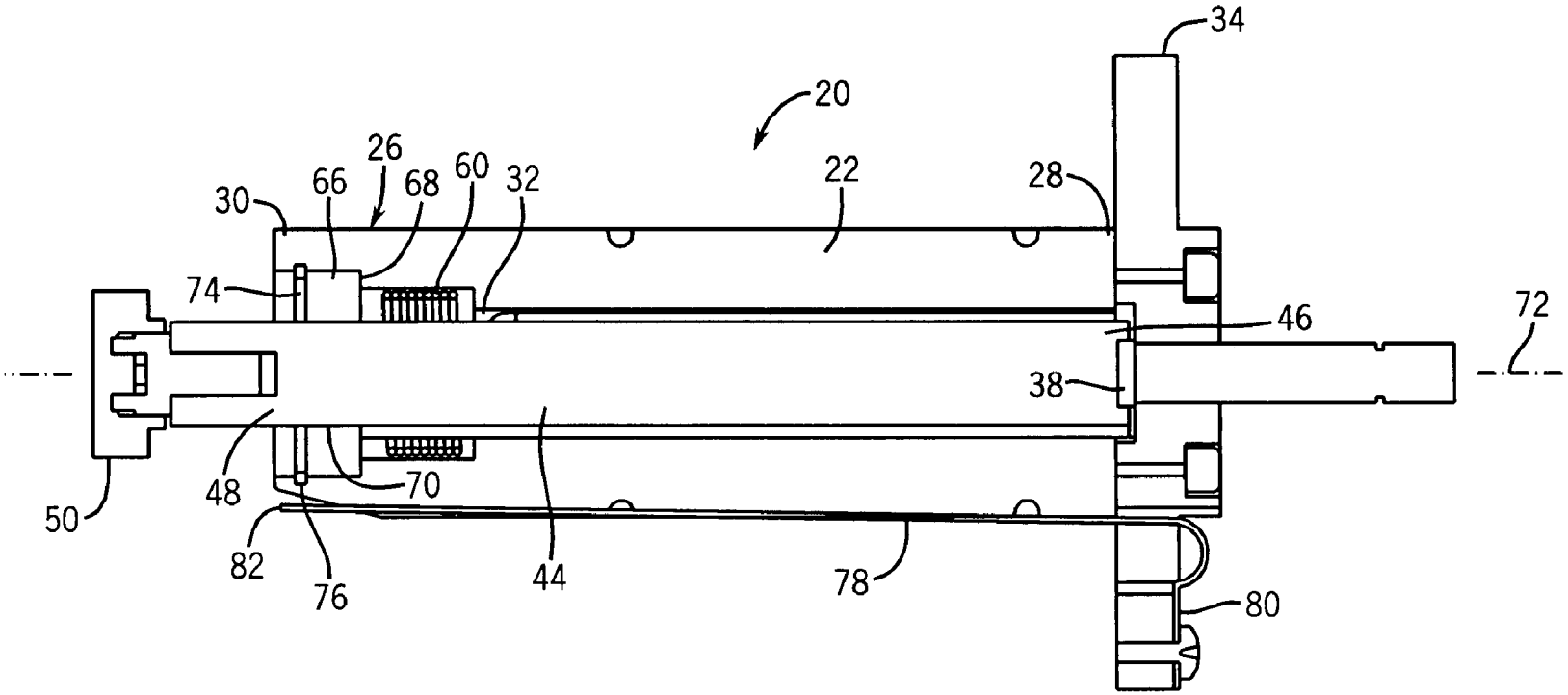
FIG. 3 is a sectional view along line 3—3 of FIG. 2.
Figure 4:
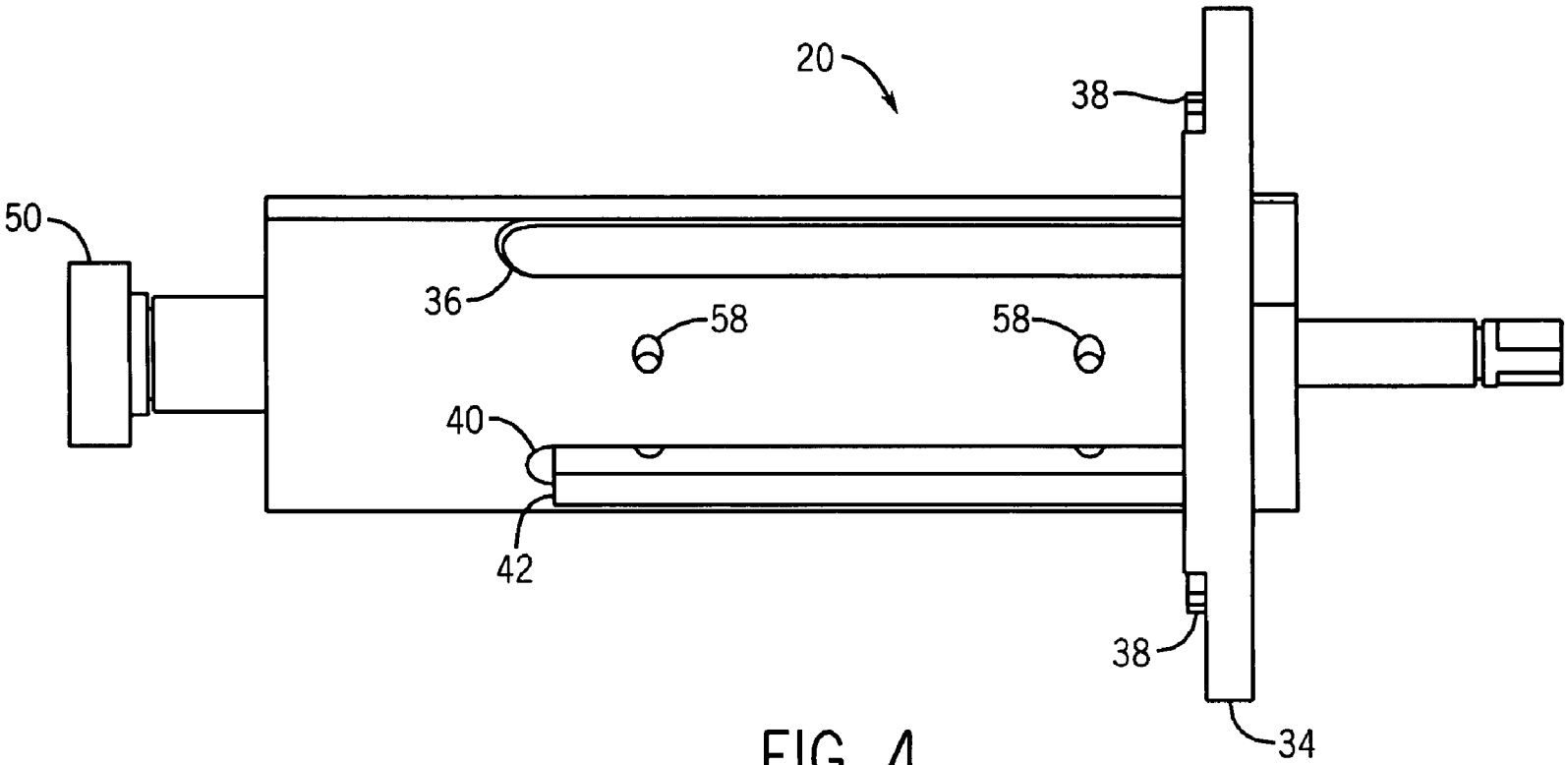
FIG. 4 is a top view of the spool of FIG. 2.
Figure 5:
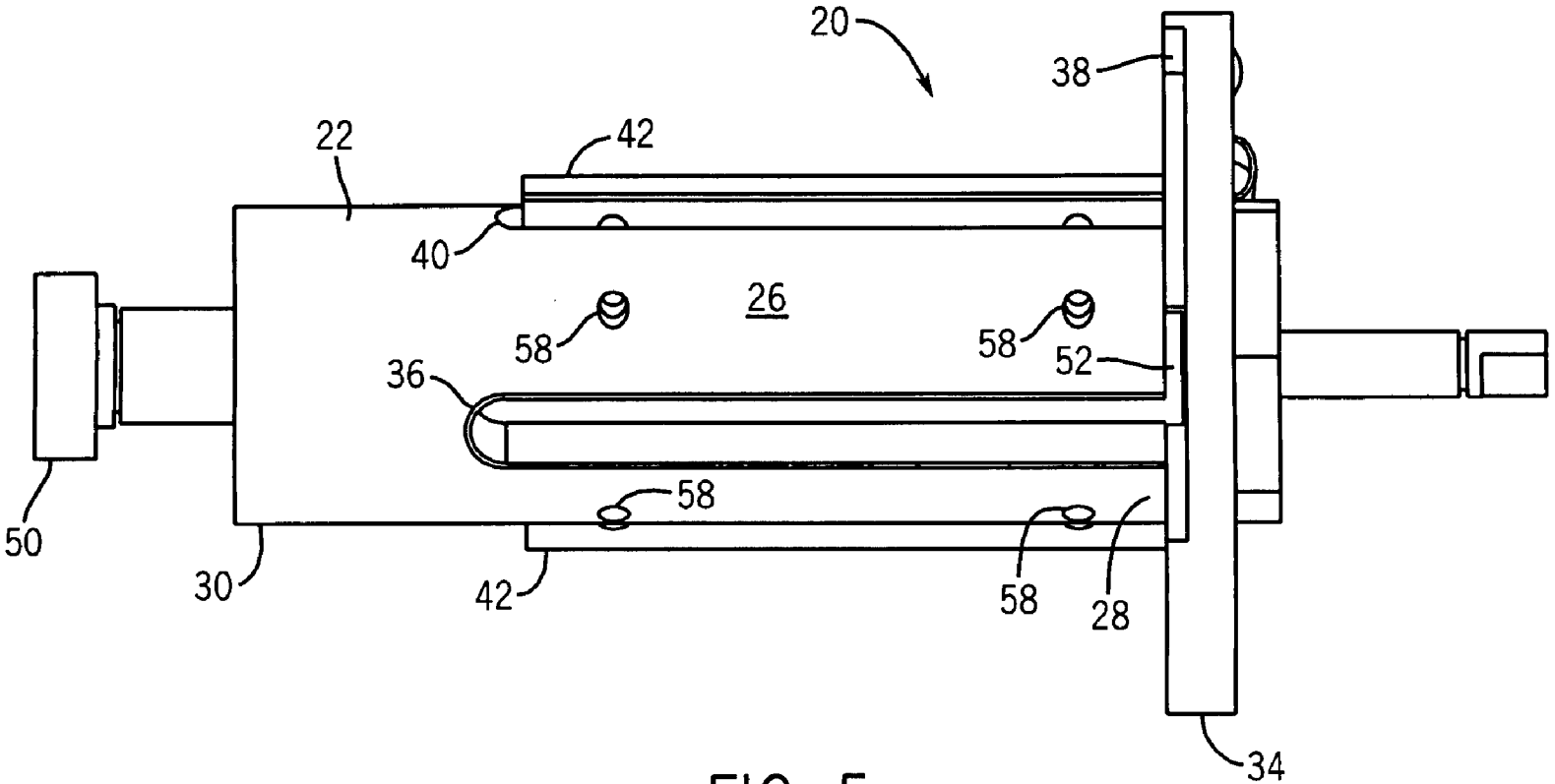
FIG. 5 is a side view of the spool of FIG. 2.
Figure 6:
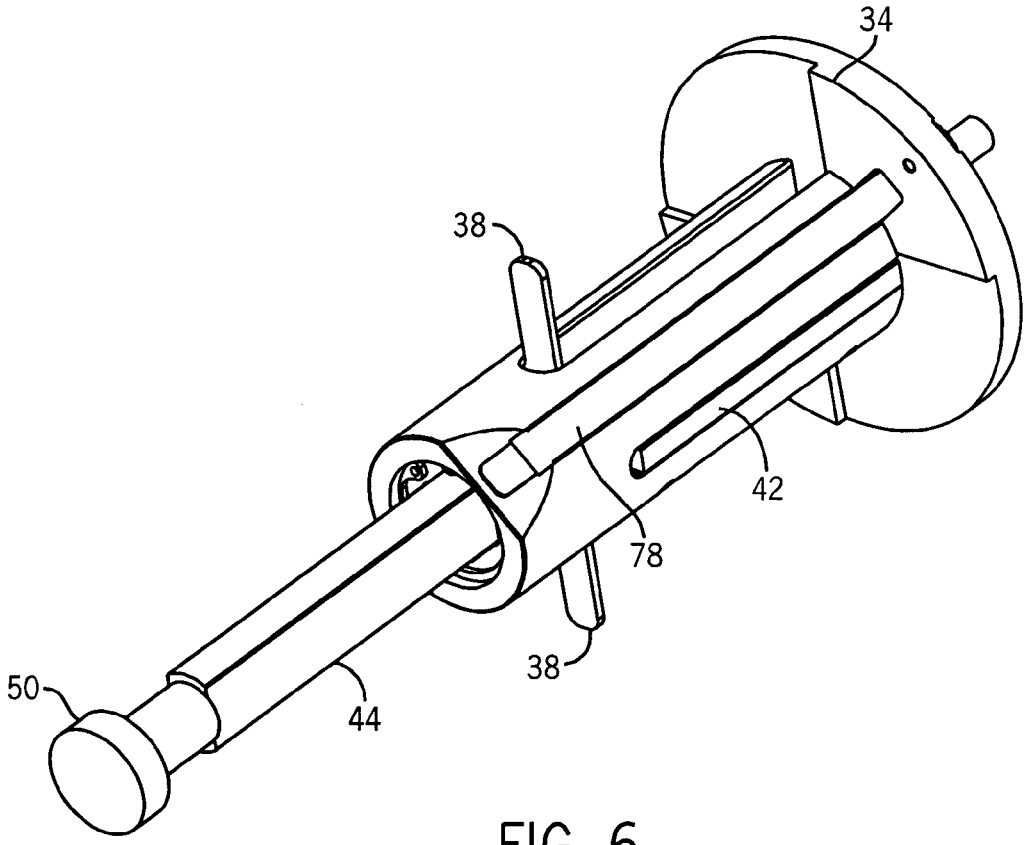
FIG. 6 is a perspective view of the spool of FIG. 2 with the cam shaft in the extended position, the expansion blades in the retracted position, and the extractor blades in the forward position.
Figure 7:
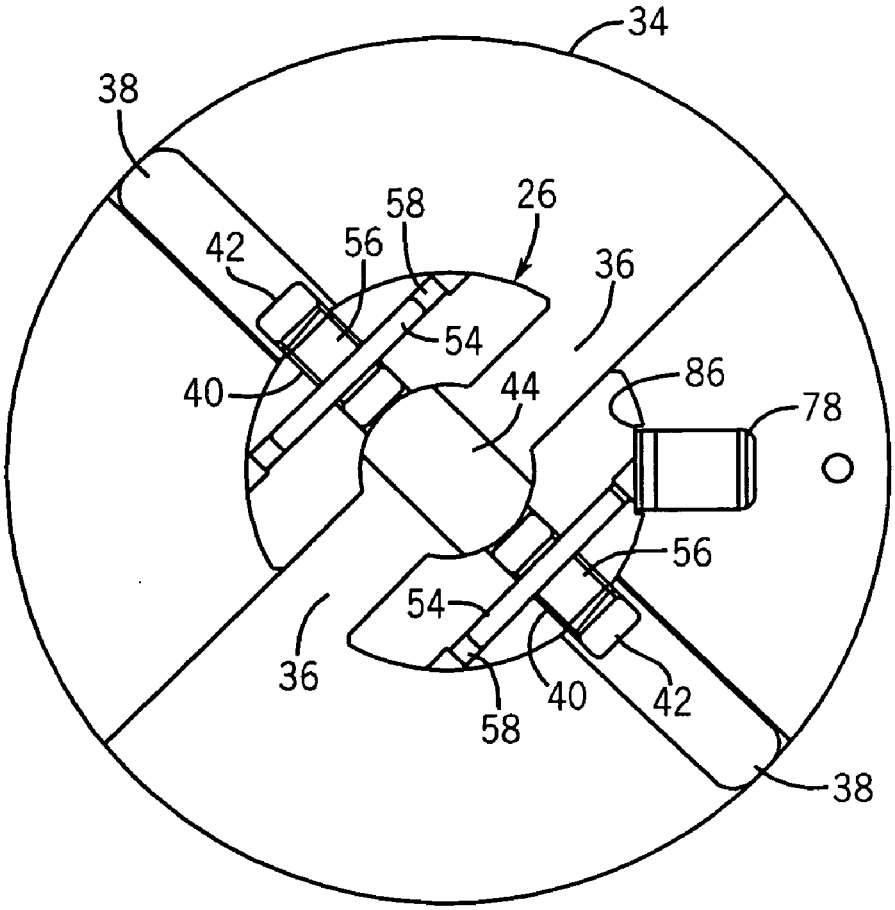
FIG. 7 is a sectional view along line 7—7 of FIG. 2.
Figure 8:
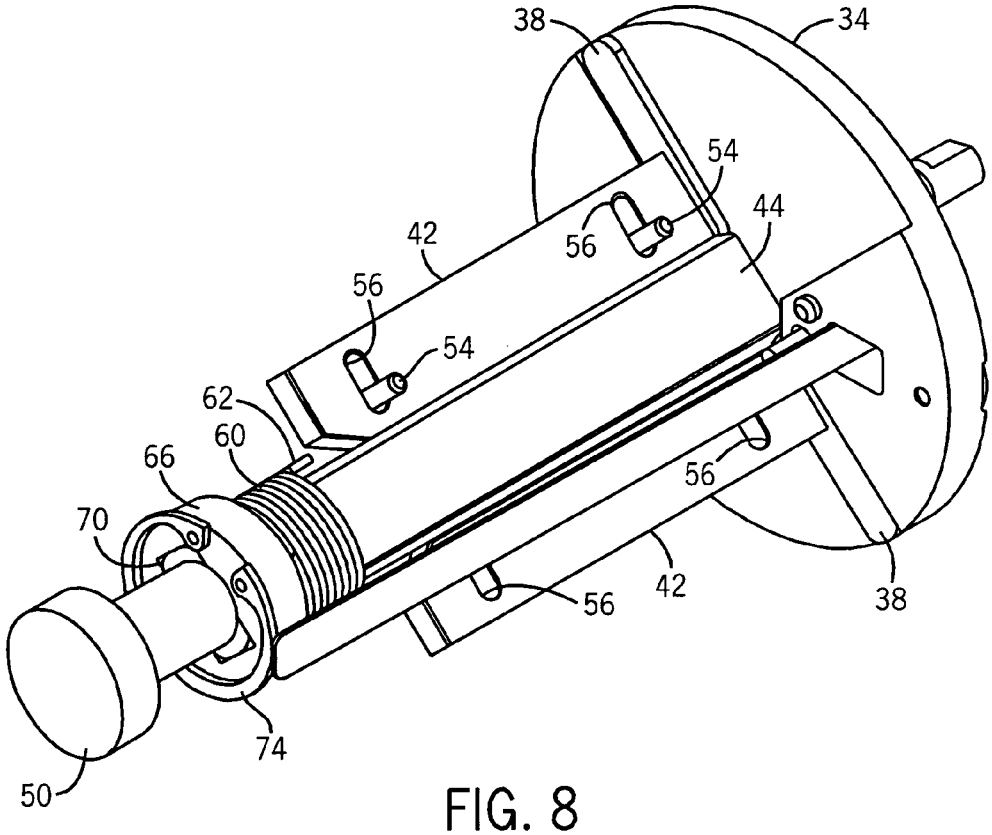
FIG. 8 is a perspective view of the spool of FIG. 2 with the body removed.
Figure 9:
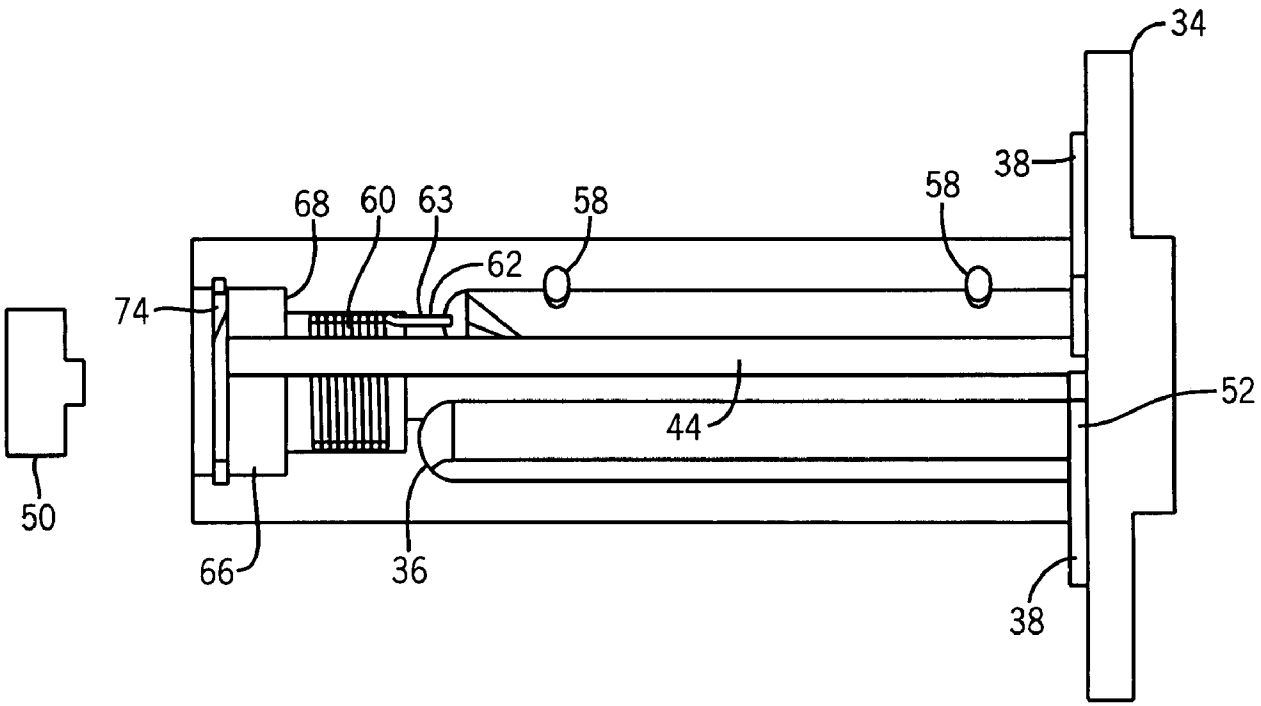
FIG. 9 is a sectional view along line 9—9 of FIG. 2.
Figure 10:
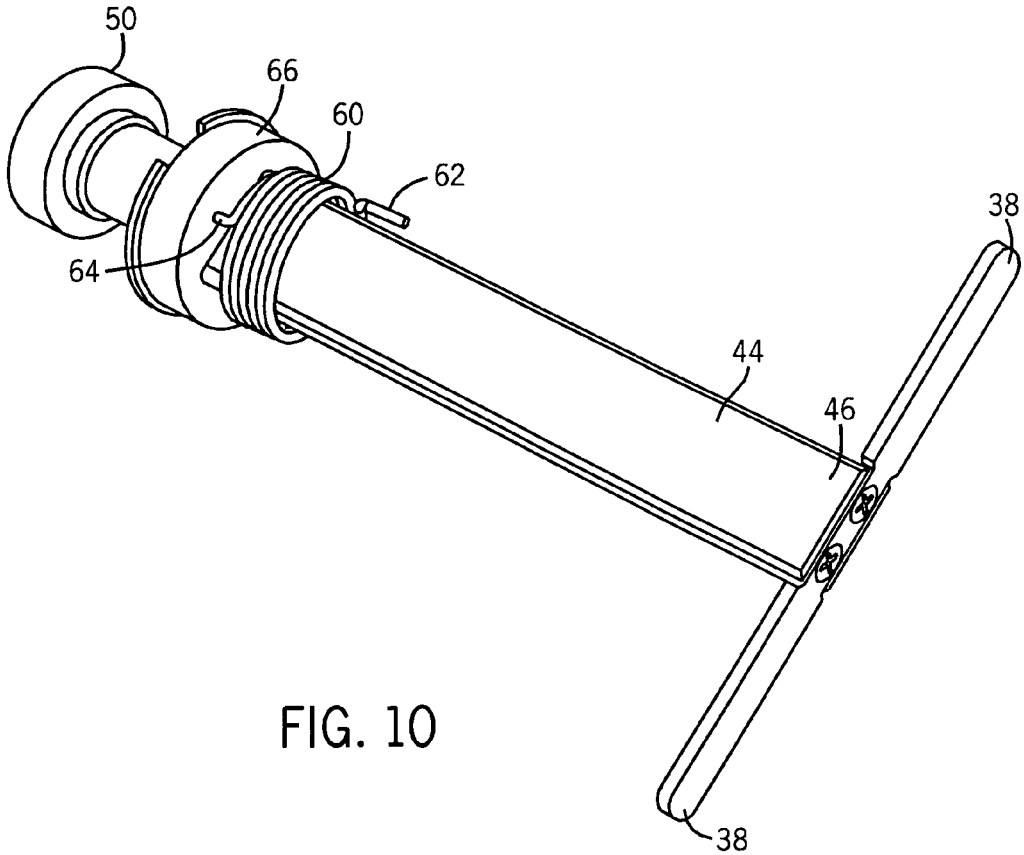
FIG. 10 is a perspective view of the cam shaft of FIG. 3.

As shown in FIG. 1, a printing system 10 includes a ribbon supply spool 12 that rotatably mounts unused ink ribbon thereon. The ink ribbon unwinds from the ribbon supply spool 12, passes over a print head 14 that transfers ink on the ink ribbon onto print media. Ribbon passed over the print head 14 is wound directly onto a ribbon rewind spool 20. The ribbon rewind spool 20 is cantilevered from a wall 24 forming part of the printing system 10, and is rotatably driven by a ribbon rewind motor 25 through an overdriven slip clutch. Advantageously, by winding the ribbon directly onto the ribbon rewind spool 20, a core for winding the ribbon thereon is not required. Although a core is not required, embodiments of the present invention can use a core.

The ribbon supply spool 12 and print head 14 are known in the art, and thus will not described herein. The ribbon rewind spool 20, however, is novel, and will be described in further detail below. Moreover, although the ribbon rewind spool 20 is especially suitable for winding spent ribbon thereon, it can be used for winding any material, such as a paper, liner, tape, fabric, and the like without departing from the scope of the invention.

In the embodiment disclosed in FIGS. 2–7, the ribbon rewind spool 20 includes a body 22 for winding the spent ribbon thereon. Preferably, the body 22 is substantially cylindrical having an outer surface 26 extending between a proximal end 28 and a distal end 30, and defines an axially extending internal cavity 32 therethrough. The proximal end 28 of the body 22 is fixed to a radially extending flange 34 using methods known in the art, such as screws, dowels, and the like. A pair of axially extending, diametrically opposing, extractor blade slots 36 are formed in the body 22 and intersect the cavity 32 to receive ribbon extractor blades 38 for simplifying the removal of ribbon wound onto the body 22. A pair of the axially extending, diametrically opposing, expansion blade slots 40 are formed in the body 22 and intersect the cavity 32 to receive expansion blades 42 for changing the effective diameter of the ribbon rewind spool 20.

The cavity 32 slidably receives a cam shaft 44 which engages the expansion blades 42. The cam shaft 44 is axially slidable in the cavity 32 between a retracted position (shown in FIG. 2) and an extended position (shown in FIG. 6) to axially move the extractor blades 38 in their respective extractor blade slots 36, and is rotatable to urge the expansion blades 42 between an expanded position (shown in FIG. 2) and a retracted position (shown in FIG. 6). A proximal end 46 of the cam shaft 44 is received in the cavity 32, and a distal end 48 of the cam shaft 44 extends axially out of the cavity 32 past the distal end 30 of the body 22. Preferably, a cam shaft knob 50 is fixed to the cam shaft distal end 48 for grasping by a user to axially move, or rotate, the cam shaft 44.

The ribbon extractor blades 38 extend radially from the cam shaft 44, and are fixed to the proximal end 46 of the cam shaft 44, using methods known in the art, such as screws, adhesives, and the like. When aligned with the extractor blade slots 36, the extractor blades 38 are slidable in the axial direction from a rearward position (shown in FIG. 2) proximal the flange 34 toward a forward position (shown in FIG. 6) proximal the body distal end 30 in their respective extractor blade slots 36 to urge ribbon off of the body 22 as a unit. In the rearward position, upon rotation of the cam shaft 44, the extractor blades 38 are received in a space 52, or radial slot, (best shown in FIG. 5) formed between the body proximal end 28 and the flange 34 to axially lock the cam shaft 44 in the retracted position. Although a pair of extractor blades 38 is shown, one or more extractor blades can be provided without departing from the scope of the invention.

Referring now to FIGS. 2, 3, and 6–10. the expansion blades 42 are cam followers that engage the cam shaft 44, and move radially through the respective expansion blade slots 40 between the expanded position and the retracted position. In the expanded position, the expansion blades 42 extend radially past the body outer surface 26 to increase the effective diameter of the ribbon rewind spool 20 (best shown in FIG. 7). In the retracted position, the expansion blades 42 are retracted into the expansion blade slots 40, such that the effective diameter of the ribbon rewind spool 20 is defined by the body outer surface 26. Pins 54 extending through transverse slots 56 formed in the expansion blades 42 are received in transverse holes 58 formed through the body 22 to limit radial travel of the expansion blades 42. Although a pair of expansion blades 42 is shown, one or more expansion blades can be provided without departing from the scope of the invention.

A torsion spring 60 interposed between the cam shaft 44 and body 22 rotatably biases the cam shaft 44 in one direction of rotation to urge the expansion blades 42 toward the expanded position and the extractor blades 38 to one edge of the space 52 formed between the body proximal end 28 and the flange 34 when the cam shaft 44 is in the retracted position. Preferably, the torsion spring 60 wraps around the cam shaft 44 and has one end 62 received in an axial hole 63 formed in the body 22 to fix the one end 62 to the body 22. An opposing end 64 of the torsion spring 60 is fixed to a slip ring 66 that rotates with the cam shaft 44 while allowing the cam shaft 44 to slide axially relative to the slip ring 66.

The slip ring 66 is received in the cavity 32 through the body distal end 30, and abuts a shoulder 68 formed in the cavity 32 that prevents axial movement of the slip ring 66 toward the body proximal end 28. An opening 70 formed through the slip ring 66 is shaped to conform to the cam shaft cross section perpendicular to the cam shaft longitudinal axis 72 to allow axial movement of the cam shaft 44 through the slip ring opening 70. The opening 70 engages the cam shaft 44 as the cam shaft 44 rotates to rotate the slip ring 66 with the cam shaft 44 against the urging of the torsion spring 60. As a result, the force exerted by the torsion spring 60 on the slip ring 66 is transferred to the cam shaft 44 to bias the cam shaft 44 to urge the expansion blades 42 to the expanded position.

The slip ring 66 is secured axially in the cavity 32 by a lock ring 74 received in a radially inwardly opening groove 76 formed in the cavity 32. The groove 76 is axially spaced toward the body distal end 30 from the cavity shoulder 68, and the lock ring 74 secures the slip ring 66 between the groove 76 and shoulder 68 to prevent axial movement of the slip ring 66 toward the body distal end 30.

The ribbon wound onto the body 22 is captured between a ribbon, or material, holder blade 78 and the body 22. Preferably, the ribbon holder blade 78 is formed from a resilient material, such as a thin strip of metal, that has one end 80 fixed relative to the spool body 22, such as to the flange 34, and an opposing free end 82 proximal the body distal end 30. The free end 82 of the holder blade 78 can be lifted by a user to slip the ribbon between the ribbon holder blade 78 and the body 22. Preferably, a slot 86 formed in the body outer surface 26 beneath the holder blade 78 receives the holder blade 78 to secure the ribbon therebetween. In the embodiment disclosed herein, the body outer surface 27 beneath the holder blade 78 is relatively flat to provide a large contact area between the holder blade 78 and body 22. However, the body outer surface 27 beneath the holder blade 78 can have any shape without departing from the scope of the invention. In a preferred embodiment, the body distal end 30 includes a chamfer 84 beneath the free end 82 of the blade holder 78 to allow easy engagement of the blade holder free end 82 by the user.

Referring now to FIGS. 1–10, when securing the leading end of the ribbon to the ribbon rewind spool 20, or winding ribbon thereon, the normal operating configuration for the ribbon rewind spool 20 is with the cam shaft 44 in the retracted position and biased by the torsion spring 60 to extend the expansion blades 42 and maximize the effective diameter of the ribbon rewind spool 20. The biased cam shaft 44 also urges the extractor blades 38 to one edge of the space 52 formed between the body proximal end 28 and the flange 34 to lock the cam shaft 44 in the retracted position.

The ribbon is fixed to the ribbon rewind spool 20 by a user sliding the ribbon under the ribbon holder blade 78 a few inches from the leading end of the ribbon, and folding the ribbon leading end back over the ribbon and ribbon holder blade 78. Advantageously, folding the ribbon over itself provides sufficient resistance from slipping from beneath the ribbon holder blade 78 when the body 22 is manually rotated to wind ribbon thereon. The body 22 is then rotated manually by the user two or more revolutions to smooth out the ribbon and ensure the ribbon will not slip off of the body 22.

Once the ribbon is secured to the ribbon rewind spool 20, ribbon is fed from the ribbon supply spool 12, past the print head 14, and wound onto the ribbon rewind spool 20 by the ribbon rewind motor 25. The slip clutch maintains a proper tension in the ribbon between the print head 14 and the ribbon rewind spool 20.

When the ribbon supply spool 12 is empty, the trailing end of the ribbon is manually wound onto the ribbon rewind spool 20. The cam shaft 44 is then rotated by the user grasping the cam shaft knob 50 against the urging of the torsion spring 60 to retract the expansion blades 42 toward the expansion blade retraction positions and to align the extractor blades 38 with the extractor blade slots 36. The user then pulls the cam shaft 44 toward the cam shaft extended position to pull the extractor blades 38 from their rearward position toward their forward position. As the extractor blades 38 are pulled toward their forward position, the extractor blades 38 engage the ribbon and slide the ribbon wound onto the body 22 toward the distal end 30 of the spool body 22 and from beneath the ribbon holder blade 78. In one embodiment, the ribbon is urged as a unit by the extractor blades 38 toward the body distal end 30, such that at least a portion of the ribbon extends past the distal end 30 of the body 22 for easy removal of the ribbon by the user. Of course, if desired, the extractor blade slots 36 can extend toward the body distal end 30 a sufficient distance in order to slide the ribbon completely off of the body 22, or stop short of the ribbon extending past the body distal end 30, without departing from the scope of the invention.

After the ribbon has been removed from the spool body 22, the cam shaft 44 is pushed by the user toward the cam shaft retracted position. Once the cam shaft 44 is in the retracted position, the torsion spring 60 urges the cam shaft to extend the expansion blades 42 and slip the extractor blades 38 to one edge of the space 52 formed between the body proximal end 28 and the flange 34 to lock the cam shaft 44 in the retracted position. A new roll of ribbon can then be loaded onto the ribbon supply spool 12, fed past the print head 14, and wound onto the ribbon rewind spool 20, as described above.

Advantageously, the ribbon rewind spool 20 disclosed herein does not wind the ribbon onto a core. Moreover, the ribbon rewind spool 20 disclosed herein provides a spool having extractor blades 38 that simplifies removal of a material wound onto the rewind spool body 22. While there has been shown and described what is at present considered the preferred embodiment of the invention, it will be obvious to those skilled in the art that various changes and modifications can be made therein without departing from the scope of the invention defined by the appended claims. For example, a spool body having a single radially outwardly opening axial slot formed in the body outer surface slidably receiving a shaft having a radially extending extractor bar fixed thereto is within the scope of the invention.

We claim:

1. A spool suitable for winding material thereon, said spool comprising:

an axially extending body having a proximal end and a distal end joined by an outer surface, and defining an axially extending cavity;

an axially extending extractor bar slot formed in said body and intersecting with said cavity;

a shaft axially slidably received in said cavity for movement between a retracted position and an extended position; and an extractor bar fixed to said shaft and extending radially through said extractor bar slot, wherein axial slidable movement of said shaft toward said extended position from said retracted position moves said extractor bar axially toward said body distal end to urge material wound onto said body toward said body distal end for removing said material from said body.

2. The spool as in claim 1, in which said body defines an effective diameter and includes an expansion blade slot formed through said body and an expansion blade movable through said slot between an expanded position and a retracted position, wherein in said expanded position said expansion blade increases the effective diameter of said body.

3. The spool as in claim 2, in which said shaft is a rotatable cam shaft and said expansion blade is a cam follower, wherein rotation of said shaft causes said expansion blade to move between said expanded position and said retracted position.

4. The spool as in claim 1, in which one end of said shaft extends out of said cavity past said body distal end, and a knob is fixed to said one end of said shaft for grasping by a user to slidably move said shaft.

5. The spool as in claim 1, in which said extractor slot extends from said body proximal end toward said body distal end.

6. The spool as in claim 1, in which said shaft is rotatably biased in one direction of rotation.

7. The spool as in claim 6, in which said shaft is rotatably biased by a torsion spring.

8. The spool as in claim 1, in which a radial slot formed in said spool receives said extraction bar upon rotation of said shaft to lock said shaft in said retracted position.

9. The spool as in claim 8, in which said body proximal end is fixed to a flange, and said radial slot is a space formed between said body proximal end and said flange.

10. The spool as in claim 1, in which a holder blade fixed to said body secures material to said body for winding the material onto said body.

11. The spool as in claim 10, in which said holder blade is a resilient elongated member having one end fixed relative to said body proximal end.

12. The spool as in claim 11, in which said holder blade extends along a relatively flat surface formed in said body outer surface.

13. The spool as in claim 11, in which said holder blade is received in a slot formed in said body outer surface.

14. A spool suitable for winding material thereon, said spool comprising:

an axially extending body having a proximal end and a distal end joined by an outer surface; and an extractor bar mounted for slidable movement relative to said body for urging material wound onto said body toward said body distal end, in which said body includes an axially extending cavity, and said extractor bar extends radially through an axially extending extractor bar slot formed in said body and intersecting with said cavity, and said extractor bar is fixed to a shaft axially slidably received in said cavity for movement between a retracted position and an extended position, wherein axial slidable movement of said shaft toward said extended position from said retracted position moves said extractor bar axially toward said body distal end to urge material wound onto said body toward said body distal end.

15. The spool as in claim 14, in which said body defines an effective diameter and includes an expansion blade slot formed through said body and an expansion blade movable through said slot between an expanded position and a retracted position, wherein in said expanded position said expansion blade increases the effective diameter of said body.

16. The spool as in claim 15, in which said shaft is a rotatable cam shaft and said expansion blade is a cam follower, wherein rotation of said shaft causes said expansion blade to move between said expanded position and said retracted position.

17. The spool as in claim 15, in which one end of said shaft extends out of said cavity past said body distal end, and a knob is fixed to said one end of said shaft for grasping by a user to slidably move said shaft.

18. The spool as in claim 15, in which said extractor slot extends from said body proximal end toward said body distal end.

19. The spool as in claim 15, in which said shaft is rotatably biased in one direction of rotation.

20. The spool as in claim 19, in which said shaft is rotatably biased by a torsion spring.

21. The spool as in claim 15, in which a radial slot formed in said spool receives said extraction bar upon rotation of said shaft to lock said shaft in said retracted position.

22. The spool as in claim 21, in which said body proximal end is fixed to a flange, and said radial slot is a space formed between said body proximal end and said flange.

23. The spool as in claim 14, in which a holder blade fixed to said body secures material to said body for winding the material onto said body.

24. The spool as in claim 23, in which said holder blade is a resilient elongated member having one end fixed relative to said body proximal end.

25. The spool as in claim 24, in which said holder blade extends along a relatively flat surface formed in said body outer surface.

26. The spool as in claim 23, in which said holder blade is received in a slot formed in said body outer surface.

* * * * *